US008508563B2

(12) United States Patent
Kobayashi

(10) Patent No.: US 8,508,563 B2
(45) Date of Patent: Aug. 13, 2013

(54) IMAGE DISPLAY APPARATUS AND CONTROL METHOD THEREOF

(75) Inventor: Koji Kobayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 13/204,216

(22) Filed: Aug. 5, 2011

(65) Prior Publication Data

US 2012/0044275 A1 Feb. 23, 2012

(30) Foreign Application Priority Data

Aug. 17, 2010 (JP) ..... 2010-182460

(51) Int. Cl.
*G09G 5/02* (2006.01)

(52) U.S. Cl.
USPC ..... 345/698; 345/699

(58) Field of Classification Search
USPC ..... 345/690, 698, 699
See application file for complete search history.

(56) References Cited

U.S. PATENT DOCUMENTS

| | | | | |
|---|---|---|---|---|
| 5,689,283 | A * | 11/1997 | Shirochi | 345/698 |
| 6,097,356 | A | 8/2000 | Fan | |
| 6,384,816 | B1 * | 5/2002 | Tabata | 345/696 |
| 6,414,657 | B1 * | 7/2002 | Kasahara et al. | 345/690 |
| 7,190,380 | B2 * | 3/2007 | Damera-Venkata et al. | 345/698 |
| 7,773,049 | B2 | 8/2010 | Ueno et al. | |
| 8,305,301 | B1 * | 11/2012 | Wedding et al. | 345/63 |

FOREIGN PATENT DOCUMENTS

| | | | |
|---|---|---|---|
| EP | 0603713 | B1 | 10/1997 |
| JP | 06-258614 | A | 9/1994 |
| JP | 2006-23710 | A | 1/2006 |

* cited by examiner

*Primary Examiner* — Kevin M Nguyen
(74) *Attorney, Agent, or Firm* — Fitzpatrick, Cella, Harper & Scinto

(57) ABSTRACT

An image display apparatus has a correction unit that performs a correction process on image signals so as to suppress luminance fluctuation caused by capacitive coupling between adjacent column wirings. The correction unit includes: a correction value generation unit that determines a correction value for a pixel to be corrected on the basis of a combination of a signal value of the pixel to be corrected and signal values of adjacent pixels which are on a column wiring next to a column wiring on which the pixel to be corrected is, and on the basis of a position of the pixel to be corrected in a column direction; and a correction operation unit that corrects a signal of the pixel to be corrected using the correction value generated by the correction value generation unit.

10 Claims, 16 Drawing Sheets

| CORRECTION VALUE (FLUCTUATION RATE) | | ADJACENT PIXEL | | |
|---|---|---|---|---|
| | | 59 | 69 | 108 |
| OWN PIXEL | 64 | + 5% | −5% | — |
| | 128 | — | — | +2% |
| | 256 | — | — | + 1% |

FIG. 6A

| CORRECTION VALUE (FLUCTUATION RATE) | | ADJACENT PIXEL | | |
|---|---|---|---|---|
| | | 59 | 69 | 108 |
| OWN PIXEL | 64 | + 5% | −5% | — |
| | 128 | — | — | +2% |
| | 256 | — | — | + 1% |

FIG. 6B

| CORRECTION VALUE (FLUCTUATION RATE) | | ADJACENT PIXEL | | |
|---|---|---|---|---|
| | | 59 | 69 | 108 |
| OWN PIXEL | 64 | +0.5 cd/m$^2$ | −0.5 cd/m$^2$ | — |
| | 128 | — | — | +1 cd/m$^2$ |
| | 256 | — | — | +1 cd/m$^2$ |

FIG.6C

| CORRECTION VALUE | | ADJACENT PIXEL | | | | | | |
|---|---|---|---|---|---|---|---|---|
| | | **0** | **5** | **10** | ・・・ | **180** | **210** | **255** |
| OWN PIXEL | **0** | 0 | 0 | 0 | | 0 | 0 | 0 |
| | **5** | 0 | 0 | −1 | | −8 | −8 | −8 |
| | **10** | 0 | 3 | 0 | | −6 | −6 | −6 |
| | ・<br>・<br>・ | | | | ・・・ | | | |
| | **180** | 0 | 0 | 0 | | 0 | 0 | −1 |
| | **210** | 0 | 0 | 0 | | 2 | 0 | 0 |
| | **255** | 0 | 0 | 0 | | 1 | 1 | 0 |

IMAGE DISPLAY APPARATUS AND CONTROL METHOD THEREOF

BACKGROUND OF THE INVENTION

1. Field of the Invention

The present invention relates to an image display apparatus in which crosstalk generated in a matrix-driven display panel is suppressed, and to a control method of the image display apparatus.

2. Description of the Related Art

Known flat panel displays (FPDs) include liquid crystal display devices (LCDs), plasma display devices (PDPs), organic EL display devices (OLEDs) and field emission display devices (FEDs).

Among the foregoing, FEDs have a passive matrix structure, i.e. a simple panel structure in which field emission elements are positioned at intersections of row wirings and column wirings. As a result, FEDs have characteristically a fast response at a low cost.

FIG. 2 is a basic configuration example of an ordinary matrix-driven image display apparatus (for instance, an FED). A plurality of column wirings 14 and a plurality of row wirings 15 are formed on a rear plate 16. Pixels (display elements) are formed at respective intersections of the column wirings 14 and the row wirings 15. The column wirings 14 are connected to a column drive circuit 12, and the row wirings 15 are connected to a row drive circuit 13, to make up thereby a display device module.

The image display apparatus of FIG. 2 comprises a control circuit 11 to which digital video image signals are inputted. The row drive circuit 13 is a circuit that applies a scan signal (selection voltage) to row wirings 15 that are to be driven, and that applies a non-selection voltage to other row wirings 15. The row wirings 15, for instance, are sequentially driven (scanned) one line at a time, from the top downwards. The column drive circuit 12 generates a driving waveform (modulation signal) for each column, on the basis of a driving row video image signal (luminance signal), and applies the generated driving waveforms to the respective column wirings 14. As a result, there can be outputted a desired video image through modulation of the luminance (electron emission amount of the electron-emitting device) of the display elements.

The trend towards ever greater size and higher definition in image display apparatuses translates into longer wirings and shorter distances between wirings. This entails greater wiring resistance and greater inter-wiring capacitance, and, accordingly, an increase in RC response time. Pixels that stand farther from the driving circuit (open end side) appear thereupon darker than pixels that stand closer to the driving circuit (driving end side). Technologies for correcting luminance variability include, for instance, technologies that involve correcting a video image signal using a correction value according to the position and gradation of a display element (U.S. Pat. No. 6,097,356), and technologies that involve correcting a video image signal in accordance with the rounding of a voltage signal through RC delay (Japanese Patent Application Laid-open No. H6-258614). The above technologies afford good correction of display defects in part of the display.

In display devices of active-matrix driving type, the distance between adjacent signal wirings (column wirings) and pixel electrodes in each pixel are small. As a result, crosstalk (poor image quality) occurs on account of capacitive coupling (transverse electric field). To deal with the above problem, technologies have been proposed in which a display signal of a pixel to be corrected is corrected on the basis of a display signal of the pixel to be corrected and display signals of adjacent pixels that influence the pixel to be corrected (Japanese Patent Application Laid-open No. 2006-23710).

However, although the technologies disclosed in U.S. Pat. No. 6,097,356 and Japanese Patent Application Laid-open No. H6-258614 allow satisfactorily correcting the position-dependant fixed unevenness of display elements, such technologies are ineffective on display defects caused by so-called crosstalk in which the degree of unevenness varies depending on the display image. Also, it has been found that some display defects remain uncorrected even when using technologies that involve correcting crosstalk on the basis of the display signal of an own pixel and display signals of adjacent pixels, as in Japanese Patent Application Laid-open No. 2006-23710.

For instance, a brightness gradient and/or chromaticity gradient may occur in the vertical direction in part of the video image pattern, as in FIG. 12A. Also, vertical streak (color) unevenness may occur in columns corresponding to the IC boundaries, as in FIG. 12B, in a case where the column drive circuit comprises a plurality of ICs and the column wirings are laid out in a pattern such as the one of FIG. 13.

Brightness may vary upon display of a display pattern such that the array is different even for a same gradation value. For instance, two patterns may be displayed, namely a checkered pattern of color units as in FIG. 14A, and a checkered pattern of white (RGB set) units, as in FIG. 14B. In this case, as illustrated in 14C, display is good at the driving end side in the vicinity of the column drive circuits, but the brightness of the two patterns are dissimilar at the open end side, and a brightness jump appears at the boundary between patterns.

As a result of diligent research, the inventors found that such phenomena arise from crosstalk caused by capacitive coupling between adjacent column wirings, in particular from the in-plane distribution of crosstalk.

This phenomenon will be explained based on FIG. 15. FIG. 15 is a simplified equivalent circuit of two column wirings. In the figure, $V_{n,0}(t)$ is the output (voltage waveform), of a column drive circuit, that is applied to an n-th column wiring at a time t, and $V_{n,y}(t)$ is the column wiring potential in the vicinity of a position y (y=1, 2, 3, 4). It is found that, since column wirings are ordinarily homogeneous, there holds $C_1 \cong C_2 \cong C_3 \cong C_4 \cong C_y$ (constant), and $R_1 \cong R_2 \cong R_3 \cong R_4 \cong R_y$ (constant), where $R_y$ is the column wiring resistance per small interval at the position y, and $C_y$ denotes the capacitance between adjacent wirings per small interval at the position y. When the modulation signals are dissimilar between the own pixel and pixels that are adjacent to the own pixel in the row direction (horizontal direction), the voltage between the ends of $C_y$ changes at a time t, and there is generated, as a result, a current $I_y$ such as the one given by Equation (1).

$$I_y \approx C_y \frac{d(V_{n-1,y}(t) - V_{n,y}(t))}{dt} \tag{1}$$

If $R_y \cdot C_y$ is small, $V_{n,y}(t)$ is substantially constant and does not depend of the position y. Accordingly, $V_{n-1,y}(t) - V_{n,y}(t)$ is likewise substantially constant and independent from the position y. Equation (1) implies that there holds $I_1 \cong I_2 \cong I_3 \cong I_4 \cong I_y$. Accordingly, the potential fluctuation (crosstalk) at the position y of the column wirings is determined by the cumulative value of IR drops of $I_y$ and $R_y$ from the driving end up to position y, as per Equation (2) to Equation (5). Here, $I_y$ is the charge-discharge current of the capacitance between adjacent wirings $C_y$, and $R_y$ is the column wiring resistance. That is, a display defect such as the one in FIG. 12A occurs on account of an IR drop derived from the column wiring resistance and the charge-discharge current of the capacitance between adjacent wirings on account of disparities between the modulation signals that are applied to adjacent column wirings. The IR drops are summated from the driving end side, and hence the crosstalk amount (IR drop) is larger at the open end. A brightness gradient such as that of FIG. 12A and/or color gradient occur(s) as a result.

$$V_{n,1}(t) \approx \sum_{y=1}^{4} (I_y \cdot R_y) \approx 4 \times I_y \cdot R_y \tag{2}$$

$$V_{n,2}(t) \approx V_{n,1}(t) + \sum_{y=2}^{4} (I_y \cdot R_y) \approx 7 \times I_y \cdot R_y \tag{3}$$

$$V_{n,3}(t) \approx V_{n,2}(t) + \sum_{y=3}^{4} (I_y \cdot R_y) \approx 9 \times I_y \cdot R_y \tag{4}$$

$$V_{n,4}(t) \approx V_{n,3}(t) + I_y \cdot R_y \approx 10 \times I_y \cdot R_y \tag{5}$$

In ordinary large display devices, the column drive circuit comprises a plurality of ICs. Accordingly, the column wiring pattern in the panel is uniform and parallel in the display region, as illustrated in FIG. 13. Outside the display region, however, the leadout portions of the wirings are formed to a tapered shape, in order to connect the column wirings to the terminals of the ICs. Accordingly, the capacitance between adjacent wirings exhibits a nonuniform distribution outside the display region. In a column wiring at an IC boundary, for instance, the distance to another adjacent wiring on one side is greater than in other column wirings. Therefore, the capacitance between adjacent wirings outside the display region becomes about half that of other signal wirings. Using the model of FIG. 15 to account for this influence, an instance where $C_1 \cong 0.5 \times C_y$, for example, corresponds to a column wiring at an IC boundary, and an instance where $C_1 \cong C_y$ corresponds to an column wiring other than at the IC boundary. Such being the case, the potential fluctuations at the various positions of the column wirings corresponding to an IC boundary are given by Equations (6) to (9) below.

$$V_{n,1}(t) \approx \frac{I_y \cdot R_y}{2} + \sum_{y=2}^{4} (I_y \cdot R_y) \approx 3.5 \times I_y \cdot R_y \tag{6}$$

$$V_{n,2}(t) \approx V_{n,1}(t) + \sum_{y=2}^{4} (I_y \cdot R_y) \approx 6.5 \times I_y \cdot R_y \tag{7}$$

$$V_{n,3}(t) \approx V_{n,2}(t) + \sum_{y=3}^{4} (I_y \cdot R_y) \approx 8.5 \times I_y \cdot R_y \tag{8}$$

$$V_{n,4}(t) \approx V_{n,3}(t) + I_y \cdot R_y \approx 9.5 \times I_y \cdot R_y \tag{9}$$

The potential fluctuation at position 1 in a column wiring at an IC boundary is $3.5 \times I_y \cdot R_y$ versus $4 \times I_y \cdot R_y$ in the case of Equation (2). At positions 2, 3 and 4, the potential fluctuation varies uniformly by $0.5 \times I_y \cdot R_y$. That is, the distribution of capacitance between adjacent column wirings outside the display region is uniformly reflected on the distribution of the crosstalk amount of the respective lines. Vertical streak (color) unevenness such as that illustrated in FIG. 12B appears thus at columns corresponding to IC boundaries.

An example has been explained above in which the capacitance between adjacent column wirings outside the display region exhibits a distribution, but the same considerations apply also to a case where it is the wiring resistance outside the display region that exhibits a distribution. That is, both a disparity (distribution) in the wiring resistance (R) between column wirings outside the display region and other column wirings, and a disparity (distribution) in the capacitance between adjacent wirings (C) outside the display region can influence the distribution of crosstalk amount in the column direction (vertical direction).

The brightness jump illustrated in FIG. 14C occurs on account of the dissimilar crosstalk amount between column wirings in the pattern of FIG. 14A and the pattern of FIG. 14B. Focusing for instance on G column wirings, the adjacent R and B column wirings in the pattern of FIG. 14A are at a constant potential. In the pattern of FIG. 14B, by contrast, a modulation signal is applied to adjacent R and B column wirings. As a result, the crosstalk amount in G column wirings is dissimilar for the display patterns of FIG. 14A and FIG. 14B. Moreover, the brightness jump between the two patterns becomes ever more noticeable towards the open end, since the crosstalk amount increases towards the open end.

The correction method of Japanese Patent Application Laid-open No. 2006-23710 is aimed at crosstalk caused by local capacitive coupling and/or transverse electric field (or longitudinal electric field), i.e. is directed at phenomena in which there is no in-plane distribution of the crosstalk amount. Therefore, conventional correction methods are virtually ineffective when the distribution of crosstalk amount in the vertical direction (column direction) is large, as in the above-described problem, and/or when there is a left-right (row direction) distribution.

SUMMARY OF THE INVENTION

In the light of the above issues, it is an object of the present invention to provide a technology that allows effectively suppressing luminance fluctuation (crosstalk) caused by capacitive coupling between adjacent column wirings, in particular, suppressing deterioration of image quality derived from the in-plane distribution of luminance fluctuation.

The present invention in its first aspect provides an image display apparatus having a plurality of pixels disposed at intersections between a plurality of row wirings and a plurality of column wirings, comprising: a row drive unit that is connected to the plurality of row wirings and sequentially outputs a scan signal to an addressed row wiring; a column drive unit that is connected to the plurality of column wirings and outputs modulation signals on the basis of luminance signals, to the plurality of column wirings in synchronism with the scan signal; and a control unit that generates the luminance signals on the basis of image signals and outputs the luminance signals to the column drive unit, wherein the control unit has a correction unit that performs a correction process on the image signals so as to suppress luminance fluctuation caused by capacitive coupling between adjacent column wirings, and the correction unit includes: a correction value generation unit that determines a correction value for a pixel to be corrected on the basis of a combination of a signal value of the pixel to be corrected and signal values of adjacent pixels which are on a column wiring next to a column wiring on which the pixel to be corrected is, and on the basis of a position of the pixel to be corrected in a column direction; and a correction operation unit that corrects a signal of the pixel to be corrected using the correction value generated by the correction value generation unit.

The present invention in its second aspect provides a control method of an image display apparatus that is provided with: a plurality of pixels disposed at intersections between a plurality of row wirings and a plurality of column wirings; a row drive unit that is connected to the plurality of row wirings and sequentially outputs a scan signal to an addressed row wiring; and a column drive unit that is connected to the plurality of column wirings and outputs modulation signals to the plurality of column wirings in synchronism with the scan signal, the method comprising the steps of: determining, in accordance with image signals, a correction value on the basis of a combination of a signal value of a pixel to be corrected and signal values of adjacent pixels which are on a column wirings next to a column wiring on which the pixel to be corrected is, and on the basis of a position of the pixel to be corrected in a column direction; performing a correction process on the image signals so as to suppress luminance fluctuation caused by capacitive coupling between adjacent column wirings, by correcting a signal of the pixel to be corrected using the correction value; and outputting, to the column drive unit, the image signals performed the correction process.

The present invention allows effectively suppressing luminance fluctuation (crosstalk) caused by capacitive coupling between adjacent column wirings, in particular, suppressing deterioration of image quality derived from the in-plane distribution of luminance fluctuation.

Further features of the present invention will become apparent from the following description of exemplary embodiments with reference to the attached drawings.

BRIEF DESCRIPTION OF THE DRAWINGS

FIGS. 6A to 6C are examples of an LUT in which combinations of signal values of an own pixel and adjacent pixels are mapped to correction values;

DESCRIPTION OF THE EMBODIMENTS

Preferred embodiments of the present invention are explained below with reference to accompanying drawings. The present invention relates to a technology for correcting crosstalk that is generated on account of capacitive coupling between adjacent column wirings in matrix-driven display panels. In the embodiments below, specific examples will be explained in which the present invention is used in an image display apparatus (FED) that utilizes field emission devices (electron-emitting devices) as pixels (display elements). The scope of use of the present invention, however, is not limited thereto, and the invention may be used in image display apparatuses other than FED, so long as the apparatus is an image display apparatus having a matrix-driven display panel.

(Overall Configuration of the Image Display Apparatus)

Figure 2:
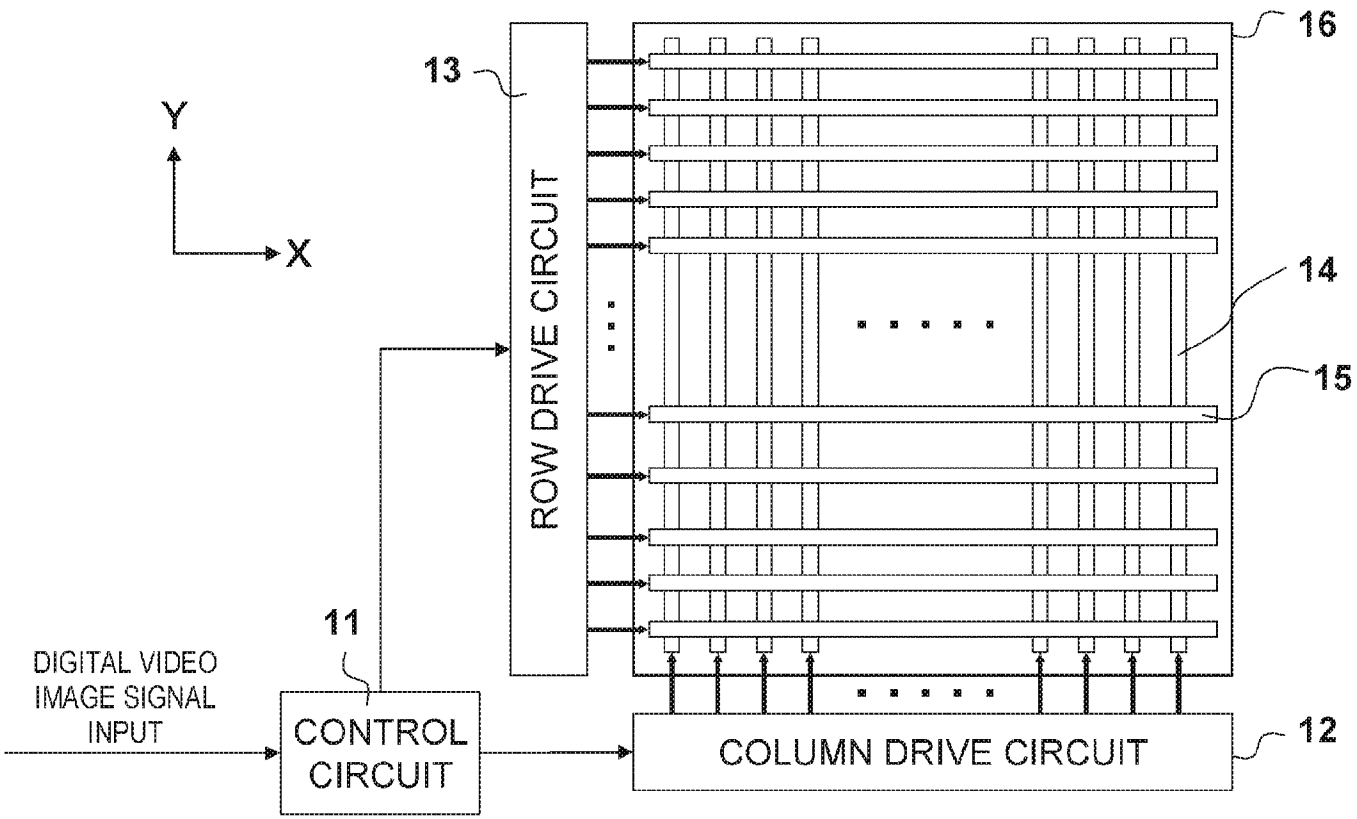
FIG. 2 is an example of a basic configuration of an ordinary matrix-driven display device.

FIG. 2 is an example illustrating the basic overall configuration of an ordinary FED. A rear plate 16 is a glass substrate that makes up a cathode panel of the FED panel. A plurality of column wirings 14 and a plurality of row wirings 15 are formed, in the form of a matrix, on the rear plate 16. Pixels (display elements) are formed at each intersection of the column wirings 14 and the row wirings 15. Although not shown in the figures, an anode panel, provided with a phosphor and an anode electrode (metal back) is disposed so as to oppose the cathode panel. The column wirings 14 are connected to a column drive circuit 12, the row wirings 15 are connected to a row drive circuit 13, and the driving circuits 12, 13 are connected to a control circuit 11. An FED module is configured thus as described above.

In a case of column wirings made up of superconductors, whereby wiring resistance is zero, no crosstalk is generated, and hence no effect is elicited through the use of the present invention. However, the present invention can be effectively used in case of ordinary wiring materials having wiring resistance, for instance Al, Cu or Ag, since a voltage drop (crosstalk) occurs herein on account of the wiring resistance and charge-discharge currents between adjacent column wirings.

(Driving Circuit Configuration)

An explanation follows next on the driving circuits and on a gradation representation method.

The row drive circuit 13 is a row drive unit that outputs sequentially a scan signal (selection voltage) to the row wirings 15. For instance, the row drive circuit 13 applies a −20 V selection voltage to addressed row wirings 15, and a 7 V non-selection voltage to other row wirings 15. The column drive circuit 12 is a column drive unit that outputs, to respective column wirings 14, modulation signals generated on the basis of a luminance signal for one line (one horizontal period). The column drive circuit 12 comprises, for instance, a shift register for input of a luminance signal for one line, a line memory for holding the luminance signal for the duration of one line, and a modulation signal generation unit that generates a driving waveform (modulation signal) Vx according to the luminance signal and that applies the driving waveform to the column wirings. The luminance signal is a digital signal for each color, for instance R, G, B. The luminance signal is generated by the control circuit 11 and is supplied to the column drive circuit 12. A voltage waveform resulting from modulating pulse width, amplitude or both can be used as the modulation signal.

Upon display of an image on the FED, the row drive circuit 13 sequentially addresses (drives) the row wirings 15, one line or a plurality of lines at a time; in synchrony therewith, the column drive circuit 12 applies simultaneously modulation signals of one image line to the column wirings 14. The irradiation dose of electron beams onto the phosphor is controlled as a result, and the image is displayed one line or a plurality of lines at a time. The electron beam irradiation dose i.e. the pixel luminance can be controlled through modification of the pulse width and/or the amplitude of the modulation signal.

The present invention can be used independently of the driving scheme. In the case of a display device of active-matrix driving type, the effect elicited by the present invention is significant, since a higher frame rate (for instance, 120 Hz or 240 Hz) in a high-definition and large screen (for instance, 1920×1080 pixels or 3840×2160 pixels) entails a shorter pixel write time. As the write period becomes shorter, it is no longer possible to secure sufficient charging ratio in amorphous Si ordinarily used at present, on account of low mobility in the latter. That is because, in such a case, the reached potential fluctuates depending on the modulation signal that is applied to adjacent wirings (if the modulation signal that is applied to adjacent wirings is of high potential, the reached potential swings towards the high-potential side, and towards a low-potential side in the opposite case), whereupon a display defect occurs due to crosstalk. In a display device of passive-matrix driving type, luminance varies depending on the driving waveform (for instance, pulse width or amplitude) of the modulation signal (not on the potential upon charge completion). Therefore, crosstalk that is generated upon shift of the amplitude of the modulation signal in adjacent column wirings keeps on being reflected on luminance. Accordingly, the present invention can be effectively used in display devices of passive-matrix driving type.

The present invention can also be used independently of the modulation scheme. In a modulation scheme where the pulse width varies, in particular, the effective fluctuation rate of pulse width on account of crosstalk is greater in a case where the pulse width is small (low gradation) than in a case where the pulse width is large (high gradation). Occurrence of uneven luminance is therefore likelier. Accordingly, display defects arising from the above-mentioned crosstalk are conspicuous, and hence the present invention can be used effectively.

(Configuration of the Control Circuit)

Figure 3:
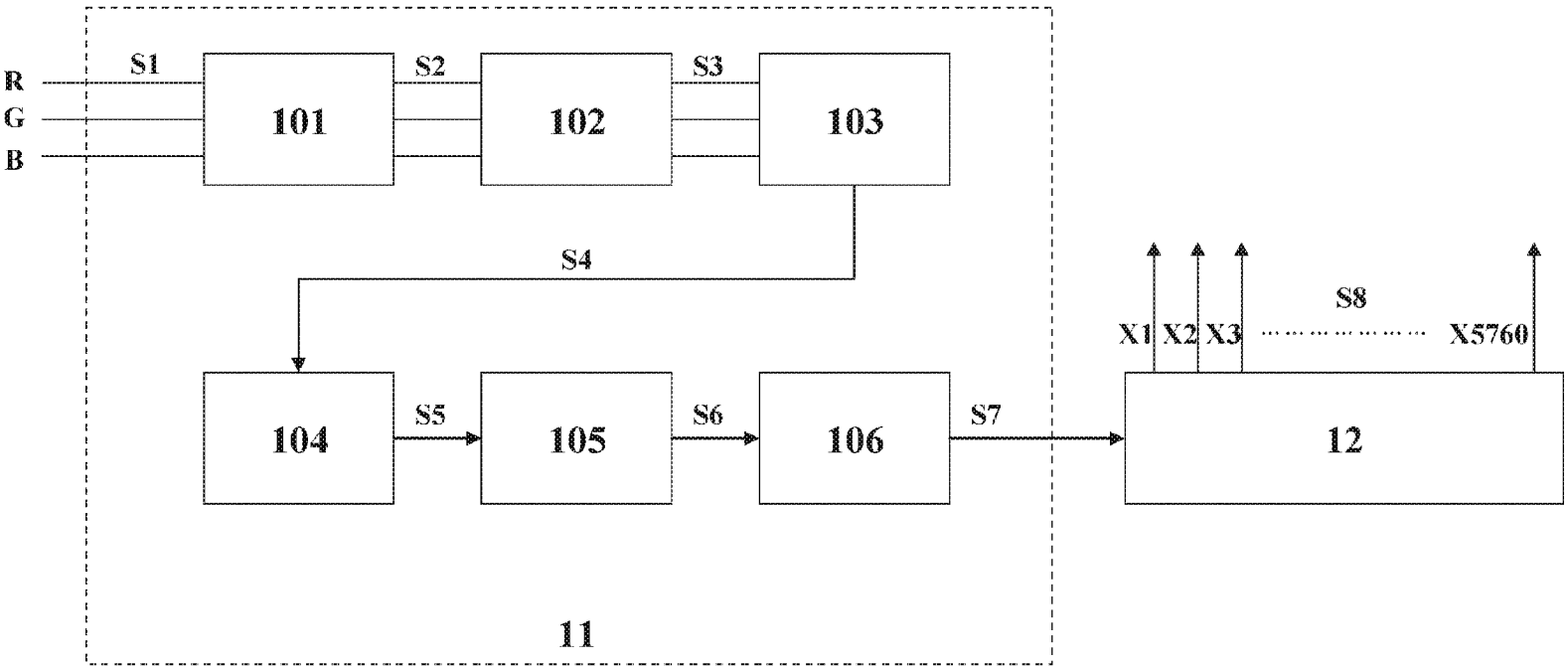
FIG. 3 is a diagram illustrating the configuration and signal flow of a control circuit.

The signal flow in the control circuit is explained next on the basis of FIG. 3. FIG. 3 is a diagram illustrating the configuration and signal flow of the control circuit 11 of FIG. 2. The control circuit 11 is a control unit that performs various correction processes and signal processes on the inputted image signal S1, generates a luminance signal and control signal in formats that are appropriate for the display panel, and outputs the luminance signal and the control signal to the column drive circuit 12 and the row drive circuit 13.

A digital component signal S1 is inputted, as an input image signal, to the control circuit 11. Through a scaler in the RGB input unit 101, the signal S1 is converted to an image signal S2 having a number of scan lines identical to the number scan lines of the display panel. The gradation correction unit 102 performs inverse gamma correction on the image signal S2 in a case where gamma correction for cancelling out the characteristic of a Cathode Ray Tube (CRT) is applied to the image signal S2. The gradation correction unit 102 can be realized in a simple matter, for instance, in the form of a table that uses the memory.

The data sorting unit 103 sorts the RGB data of the image signal S3, so as to conform to the phosphor array of the display panel, and outputs a signal S4. The signal S4 is subjected to inverse gamma correction by the gradation correction unit 102, and is therefore data having a value that is proportional to luminance (hereafter, "luminance data", "luminance signal"). In the present embodiment, the below-described correction process (104 to 106) is performed on the luminance data, but the present invention is not limited thereto. In a case where, for instance, gamma correction is applied to the data, a correction effect identical to the above-described one can be achieved if the correction value is determined in accordance with the gamma characteristic.

The luminance data S4 is inputted to the uneven luminance correction unit 104 and is corrected so as to yield data (S5) that allows correcting uneven luminance (hereafter, "corrected luminance data S5"). The uneven luminance that is corrected by the uneven luminance correction unit 104 denotes unevenness that is fixedly determined on the basis of, for instance, the characteristic, position and gradation of the display element itself (this unevenness will be referred to as "fixed unevenness", for distinguishing the latter from uneven luminance due to crosstalk"). The corrected luminance data S5 is inputted to the crosstalk correction unit 105 and is corrected so as to yield data (S6) that allows correcting crosstalk. The corrected luminance data S6 is inputted to the linearity correction unit 106 that corrects non-linearity arising from the saturation characteristic of the phosphor and from the modulation signal (column wiring driving waveform). Dissimilar tables for each R, G, B color may be supported in a case where the saturation characteristics of the phosphors for each color R, G, B are different.

The luminance data (luminance signal) S7 outputted by the linearity correction unit 106 is inputted to the column drive circuit 12. The column drive circuit 12 generates a modulation signal S8 in accordance with the value of the luminance data S7, and outputs the modulation signal S8 to all the column wirings 14 for one line (5760 wirings from X1 to X5760 in full HD). In synchrony therewith, the row drive circuit 13 outputs a selection voltage (scan signal) to the row wirings 15 to be driven. The electron-emitting device connected to the selected row wirings 15 performs electron emission according to the modulation signal that is applied to the column wirings 14. The emitted electrons are accelerated on account of the anode voltage, and strike the phosphor. The phosphor emits light as a result, and the image is displayed.

Thus, the crosstalk correction unit 105 performs a correction process after the uneven luminance correction unit 104 and before the linearity correction unit 106. That is because the crosstalk amount is determined by a combination of the modulation signals (S7 and S8), and hence performing the correction process as late as possible makes occurrence of errors less likely to occur in the correction operation, and also because the explanation is more simple for a linear signal (luminance data and corrected luminance data) with respect to luminance. However, the invention is not limited to a configuration such as the one of FIG. 3, and crosstalk correction may be performed before the uneven luminance correction unit 104 or after the linearity correction unit 106. In such cases, the correction value that is used in the respective correction processes may be appropriately adjusted in accordance with the sequence of the corrections.

Figure 4:
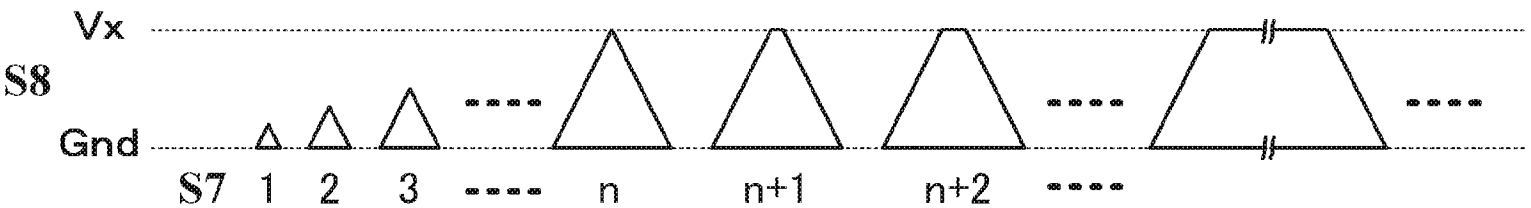
FIG. 4 is an example of modulation signal waveforms.

Although the present invention can be used independently of the modulation scheme, the explanation below will deal, for convenience, with a case in which there is used a modulation signal such as the one of FIG. 4. In FIG. 4, the abscissa axis represents voltage value and the ordinate axis represents time. Waveforms of the modulation signal S8 corresponding to respective values of the output S7 of the linearity correction unit 106 are depicted horizontally side by side. Herein, the output S7 has a value corresponding to the signal level that the modulation signal S8 can take, such that the smaller the value of the output S7 is, the smaller becomes the signal level of the modulation signal S8. FIG. 4 illustrates waveforms of a modulation signal in a pulse width modulation scheme wherein the rise and fall have linear slopes. When the output S7 is small (low gradation), the amplitude falls short of a maximum amplitude Vx and takes on a triangular waveform (actually, a triangular waveform with rounded rise and fall). When the output S7 is greater than n+1, the amplitude reaches the maximum amplitude Vx, and the waveform becomes a trapezoidal waveform (actually, a trapezoidal waveform with rounded rise and fall). The above modulation scheme is a scheme wherein the pulse width and the amplitude are modulated as a result. Images are therefore obtained that have a large modulation range and a large dynamic range.

The above-described features are shared by the various embodiments described below. Specific embodiments of the crosstalk correction unit are explained next.

First Embodiment

Figure 1:
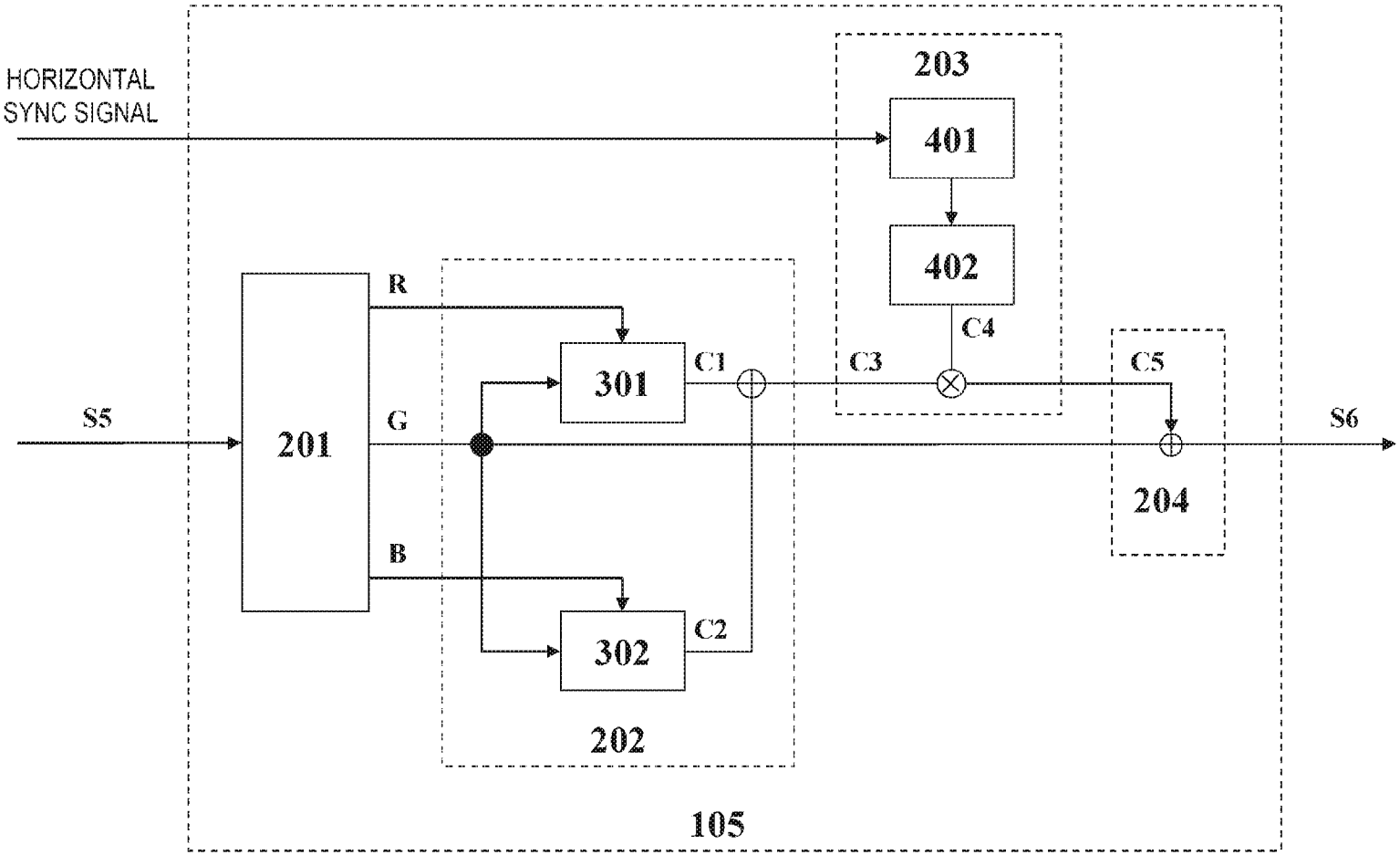
FIG. 1 is a diagram for explaining a configuration example of a crosstalk correction unit in a first embodiment.

The crosstalk correction unit in a first embodiment of the present invention will be explained next based on FIG. 1. The crosstalk correction unit 105 can mainly comprise, for instance, a data sorting unit 201, a gradation combination correction unit 202, a column direction correction unit 203 and correction operation unit 204. In the present embodiment, the gradation combination correction unit 202 and the column direction correction unit 203 correspond to the correction value generation unit of the present invention, and the correction operation unit 204 corresponds to the correction operation unit of the present invention.

The corrected luminance data S5, having undergone fixed unevenness correction, is inputted to the data sorting unit 201. The data sorting unit 201 outputs, to the gradation combination correction unit, corrected luminance data S5 of a pixel to be crosstalk-corrected (own pixel) (G in FIG. 1) as well as corrected luminance data of pixels (adjacent pixels) (R and B in FIG. 1) that are adjacent to the pixel to be corrected. Herein, "adjacent pixels" denote pixels that are connected to a same row wiring as that of the own pixel, and that are connected to column wirings adjacent to the column wiring of the own pixel.

(Gradation Combination Correction Unit)

In the gradation combination correction unit 202, corrected luminance data of the own pixel G and corrected luminance data of an adjacent pixel R are inputted to the GR correction value generation unit 301. The GR correction value generation unit 301 determines, and outputs, a correction value C1 according to a combination of a signal value (gradation level) of the own pixel and a signal value (gradation level) of the adjacent pixel. The corrected luminance data of the own pixel G and the corrected luminance data of the adjacent pixel B are inputted to the GB correction value generation unit 302. The GB correction value generation unit 302 determines, and outputs, a correction value C2 according to a combination of a signal value (gradation level) of the own pixel and a signal value (gradation level) of the adjacent pixel. The correction values C1, C2 are totaled and the resulting correction value C3 is outputted.

Figure 5:
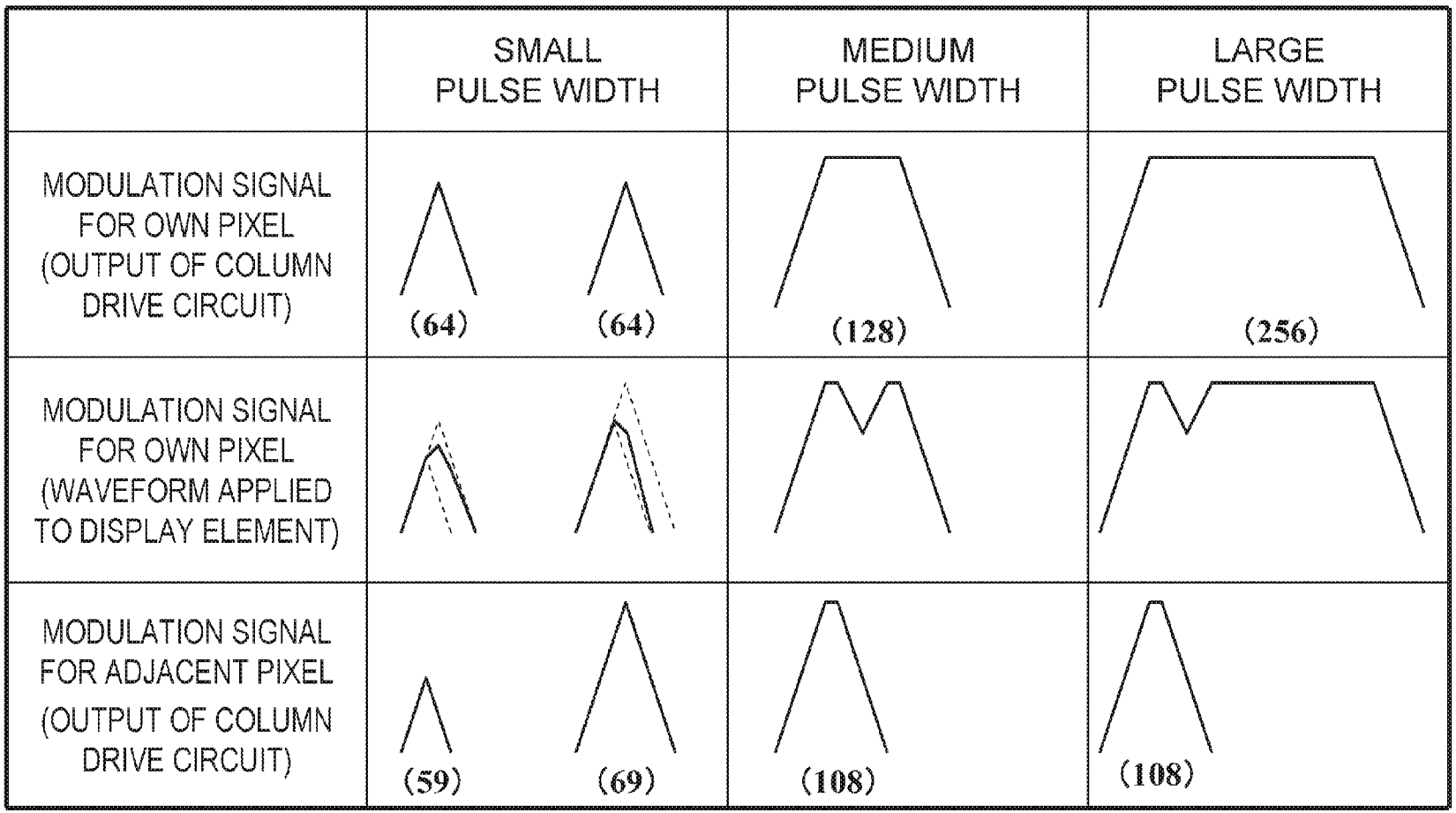
FIG. 5 is a diagram for explaining waveform disturbance in modulation signals caused by crosstalk.

The operation of the GR correction value generation unit 301 will be explained next based on FIG. 5 and FIG. 6. FIG. 5 is a diagram illustrating schematically the fluctuation of a modulation signal in an own pixel, due to crosstalk, for three modulation signals. FIG. 5 illustrates an example of an 8-bit modulation signal (256 gradations). From left to right, the figure depicts a modulation signal having a small pulse width, a modulation signal having a medium pulse width and a modulation signal having a large pulse width. In the figure, the numerical values in brackets indicate the value (gradation level) of the signal S7. In a case of large pulse width of the modulation signal for the own pixel (for instance, S7=256) and small pulse width of the modulation signal for the adjacent pixel (for instance, S7=108), the voltage of the modulation signal of the own pixel fluctuates, through capacitive coupling, during the fall of the modulation signal of the adjacent pixel. The luminance of the own pixel drops as a result (for instance, luminance fluctuation rate of −1% and luminance fluctuation value of −1 cd/m$^2$). Compared with a case where the pulse width of the own pixel is large (S7=256), the luminance fluctuation rate on account of crosstalk roughly doubles (−2%) when the pulse width of the own pixel is halved (S7=128), for identical pulse widths of the adjacent pixel (S7=108). The luminance fluctuation value is substantially identical (−1 cd/m$^2$) to that of a case where the pulse width is large. In a case where the pulse width of the own pixel is small (S7=64), the luminance fluctuation rate on account of crosstalk increases (for instance, to 5%), but, conversely, the luminance fluctuation value decreases (for instance, to 0.5 cd/m$^2$). This is because the voltage dependence of the electron emission characteristic obeys an exponential function, and hence, for a same voltage fluctuation, a smaller original voltage value translates into a smaller change in the absolute value of the amount of electron emission. As FIG. 5 shows, when the pulse width of the own pixel is small (for instance, S7=64), and the pulse width of the adjacent pixel is smaller (for instance, S7=59) than the pulse width of the own pixel, the own pixel darkens (for instance, luminance fluctuation rate of −5% and luminance fluctuation value of −0.5 cd/m$^2$). Conversely, when the pulse width of the adjacent pixel is greater (for instance, S7=69) than the pulse width of the own pixel, the own pixel brightens (for instance, luminance fluctuation rate of +5% and luminance fluctuation value of +0.5 cd/m$^2$).

As described above, the fluctuation rate and fluctuation value of the luminance of the own pixel varies depending on a combination of the signal values (gradation levels) of the own pixel and the adjacent pixel. Therefore, the GR correction value generation unit can use a two-dimensional look-up table, such as the one illustrated schematically in FIG. 6A or FIG. 6B, for determining a correction value. FIG. 6A shows correction values based on a luminance fluctuation rate. In this case, the reciprocal of the fluctuation rate is used as the correction value, and correction is performed by multiplying the correction value by the own pixel signal. FIG. 6B shows correction values based on a luminance fluctuation value. In this case, the additive inverse of the fluctuation value is used as the correction value, and correction is performed by adding the correction value to the own pixel signal.

FIG. 6C indicates a specific example of a look-up table. Herein, a large memory is required for holding the correction values of all the combinations of signal values (gradation levels) of the own pixel and the adjacent pixel. Accordingly, a practical circuit can be realized by creating a look-up table with intervals such that changes in the correction value are of the order of the human detection limit (about 1%). The correction values vary also, although slightly, for each color, and hence the correction values are preferably held for each color combination.

An example has been explained above in which the look-up table holds correction values for each combination of the signal values of an own pixel and an adjacent pixel. However, other design are also possible in which the look-up table is configured so as to hold correction values for difference values of the signal of the own pixel and the signal of the adjacent pixel, through optimization (or conversion) of the modulation scheme or the signals to be corrected (the corrected luminance data in the above-described example). The detailed configuration is not limited, so long as means exists for determining a correction value in accordance with the combination of the modulation signals of the own pixel and the adjacent pixel.

(Column Direction Correction Unit)

The column direction correction unit 203 is explained next based on FIG. 1 and FIG. 7. The column direction correction unit 203 is a circuit that adjusts the correction value C3 using the column-direction adjustment value C4 according to the position of the column direction (vertical direction) of the own pixel. The purpose of performing such column direction correction (column direction adjustment) is to correct the column-direction distribution of the luminance fluctuation amount (crosstalk amount) caused by a voltage drop derived from the wiring resistance of the column wirings.

The column direction correction unit 203 receives the input of a horizontal synchronizing signal and the correction value C3 outputted by the gradation combination correction unit 202. The column direction correction unit 203 may comprise a scan row information generation unit 401, a column direction correction value generation unit 402 and a column direction correction value operation unit. The scan row information generation unit 401 counts the horizontal synchronizing signals by way of a counter circuit, and outputs, to the column direction correction value generation unit 402, information corresponding to the row wiring number to which the signal S5 belongs.

Herein, the number of the row wiring 15 that stands closest to the column drive circuit 12 is arbitrarily set to 1, such that the number increases by units of one towards an open end (top of the panel). The signal to be corrected is proportional to the luminance, and the correction value C3 of the gradation combination correction unit 202 is multiplied by the signal to be corrected in order to correct the luminance fluctuation rate. In this case, the column direction correction value generation unit 402 may create a one-dimensional look-up table such as the one illustrated in FIG. 7.

Figure 7:
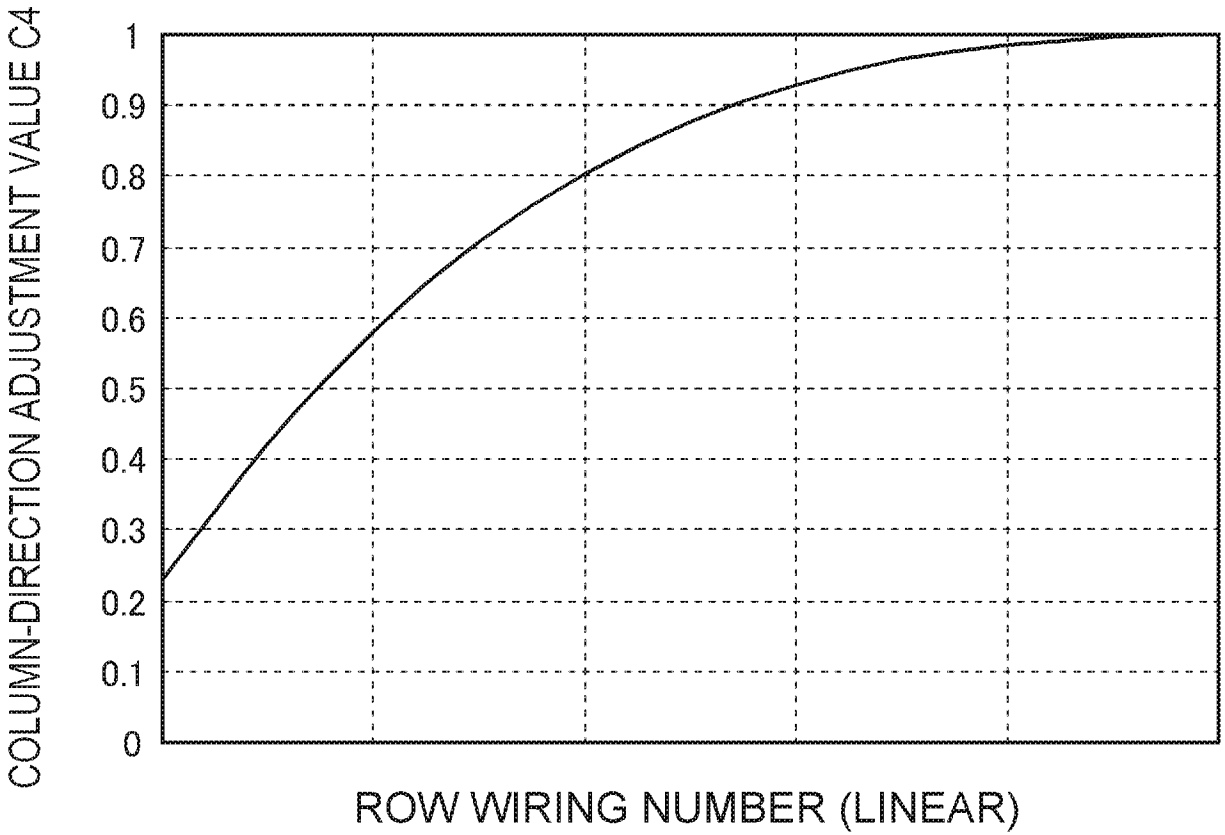
FIG. 7 is a diagram for explaining a configuration example of a column direction correction value generation unit.
Figure 15:
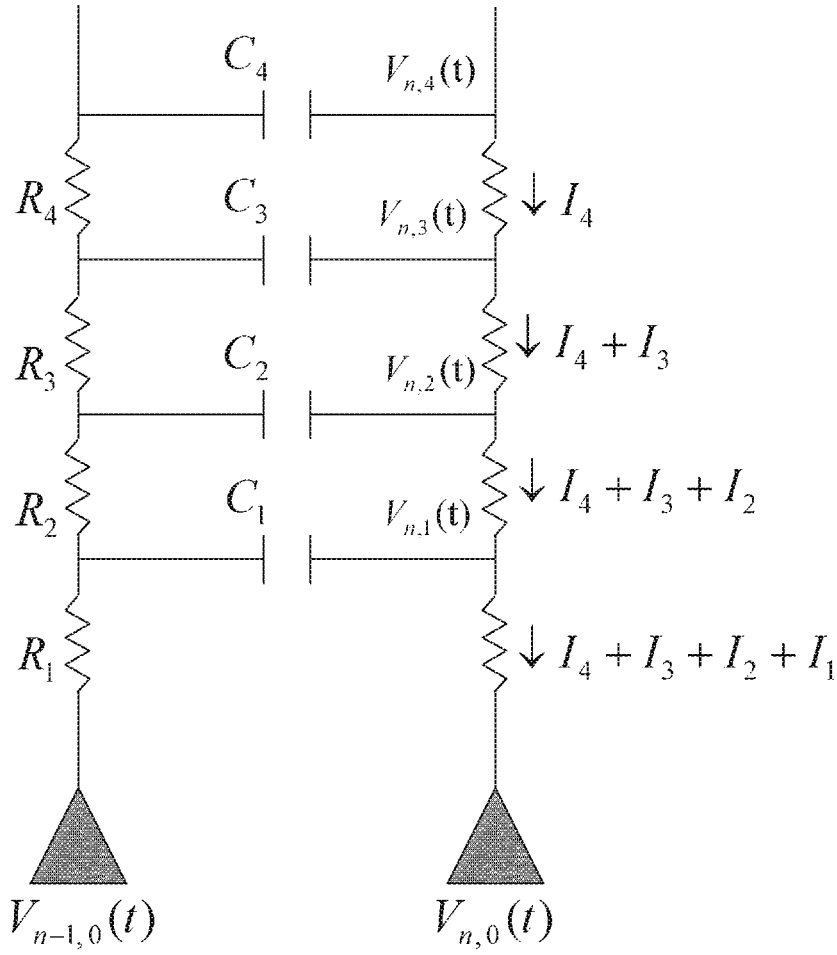
FIG. 15 is an example of an equivalent circuit for explaining the mechanism of display defect occurrence.

In FIG. 7 the abscissa axis represents the row wiring number and the ordinate axis represents the column-direction adjustment value C4. As explained based on in FIG. 15 and equations (1) to (5), the crosstalk amount depends on a value that results from summating, up to a position corresponding to a respective row wiring, the voltage drop derived from the wiring resistance and the charge-discharge current for the capacitance between adjacent wirings. Accordingly, the adjustment value C4 increases the farther away from the column drive circuit 12 (towards the open end), in accordance with the wiring resistance distribution in the column wirings to be corrected and in accordance with the distribution of the inter-wiring capacitance (column direction) of the column wirings to be corrected and column wirings adjacent to the foregoing column wirings. Further, at regions of low row wiring number, the current value is large, and the rate of change of the current value with respect to the change in row wiring number is small (can be viewed as substantially constant). Therefore, voltage drop on account of wiring resistance is dominant, and the adjustment value C4 changes substantially linearly and abruptly. By contrast, at regions of high row wiring number, the current value is small, and the rate of change of the current value with respect to the change in the row wiring number is substantial (the current at the topmost portion on the open end side is about half the current at a position corresponding to the second row from the topmost portion, and one third of the current at a position corresponding to the third row from the topmost portion). Accordingly, the curve in FIG. 7 is top-convex with a decreasing slope. The curve can be calculated on the basis of a simple calculation if the inter-wiring capacitance, the wiring resistance and the modulation signal are known. The curve can also be acquired in a simple manner through actual measurement of luminance by changing the combination of the modulation signal of the own pixel and the adjacent pixels and by changing the position in the column direction. The absolute value (scale) in the ordinate axis of FIG. 7 may be adjusted in accordance with the output C3 of the gradation combination correction unit 202. For instance, the adjustment value C4 may be set to 1 at the highest row wiring number (open end), as illustrated in FIG. 7, in a case where the look-up table of the gradation combination correction unit 202 is configured in such a manner that the output C3 becomes the correction value at the highest row wiring number (open end).

The column direction correction value operation unit operates the output C3 of the gradation combination correction unit 202 with the output C4 of the column direction correction value generation unit 402, and outputs a final correction value C5 for crosstalk correction. In the above example, the column direction correction value operation unit may be a multiplier. The column direction correction value operation unit may be an adder if the signal to be corrected is a signal for correction through addition and subtraction of a fluctuation rate in a logarithmic signal system. The detailed configuration of the column direction correction value operation unit is not limited, and may be optimally designed in accordance with the form and features of the signals to be corrected and the correction values.

The correction operation unit 204 operates the output C5 of the column direction correction unit 203 with a G signal to be corrected. The correction operation unit 204 may comprise a multiplier in a case where the correction value C5 is a reciprocal of the luminance fluctuation rate. The correction operation unit 204 may comprise an adder in a case where the correction value C5 is an additive opposite of the luminance fluctuation value. A crosstalk correction luminance signal S6, in which there has been accurately corrected the crosstalk as determined by the column direction position of the own pixel and a combination of the signal values of the own pixel and adjacent pixels, is outputted to the linearity correction unit 106. The detailed configuration of the correction operation unit 204 is not limited, and may be optimally designed in accordance with the form and features of the signals to be corrected and the correction values.

Figure 12A:
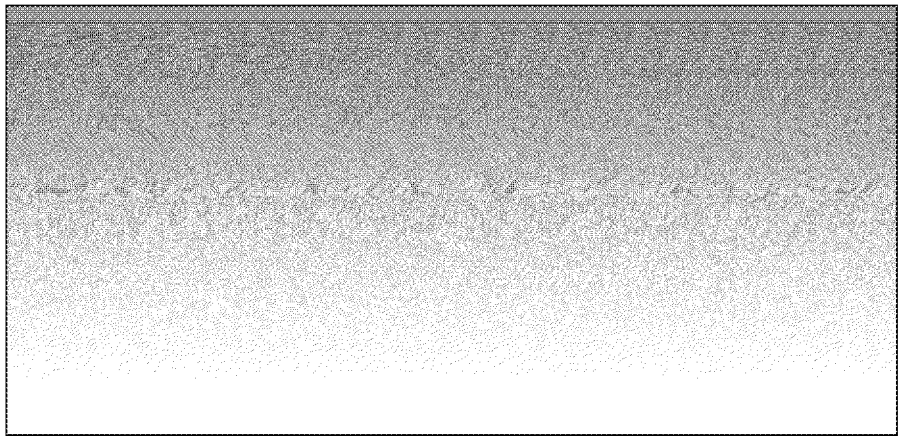
FIGS. 12A and 12B are examples of display defects caused by crosstalk.
Figure 14A:
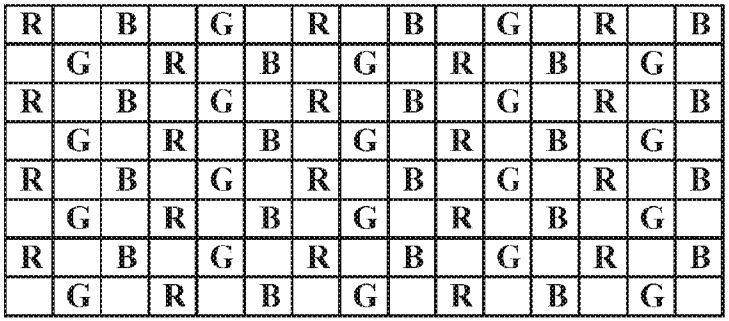
FIGS. 14A to 14C show an example of a display pattern in which a display defect occurs.
Figure 14B:
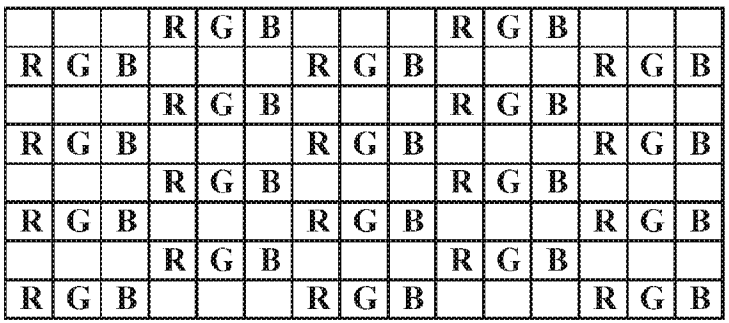
Figure 14C:
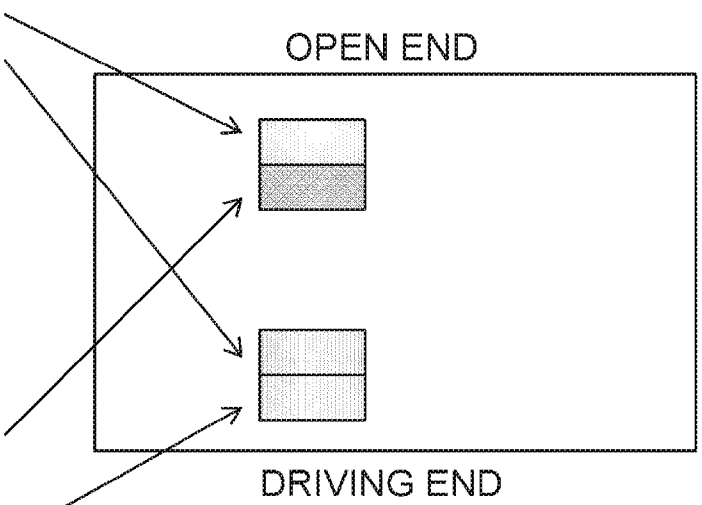

In the present embodiment, as described above, the correction value C5 for crosstalk correction is determined on the basis of a combination of the signal values of the own pixel and adjacent pixels, and on the basis of the position of the own pixel in the column direction. Specifically, the correction value C3 corresponding to a combination of the signal values of the own pixel and adjacent pixels is obtained, and thereafter the correction value C3 is adjusted using the adjustment value C4 according to the position of the own pixel in the column direction. Such a configuration allows correcting the luminance fluctuation (crosstalk) caused by capacitive coupling between column wirings, as well as the variability of luminance fluctuation in the column direction. Occurrence of display defects such as those illustrated in FIG. 12A and FIG. 14C can be thus suppressed.

Second Embodiment

Figure 12B:
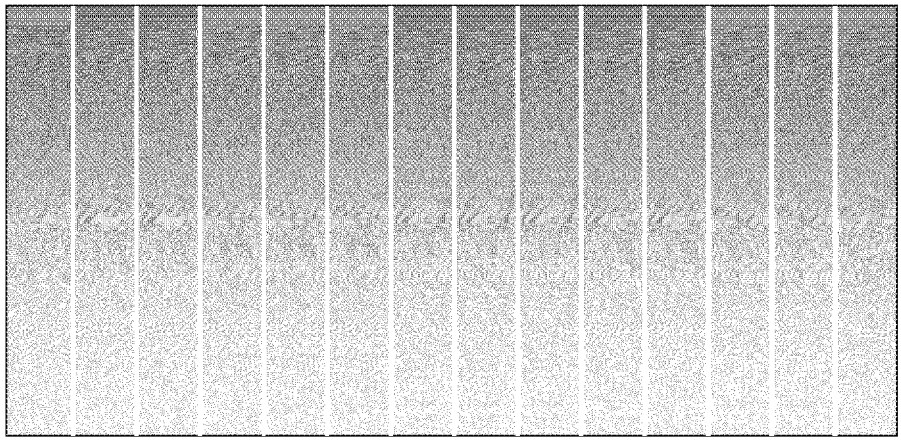
Figure 13:
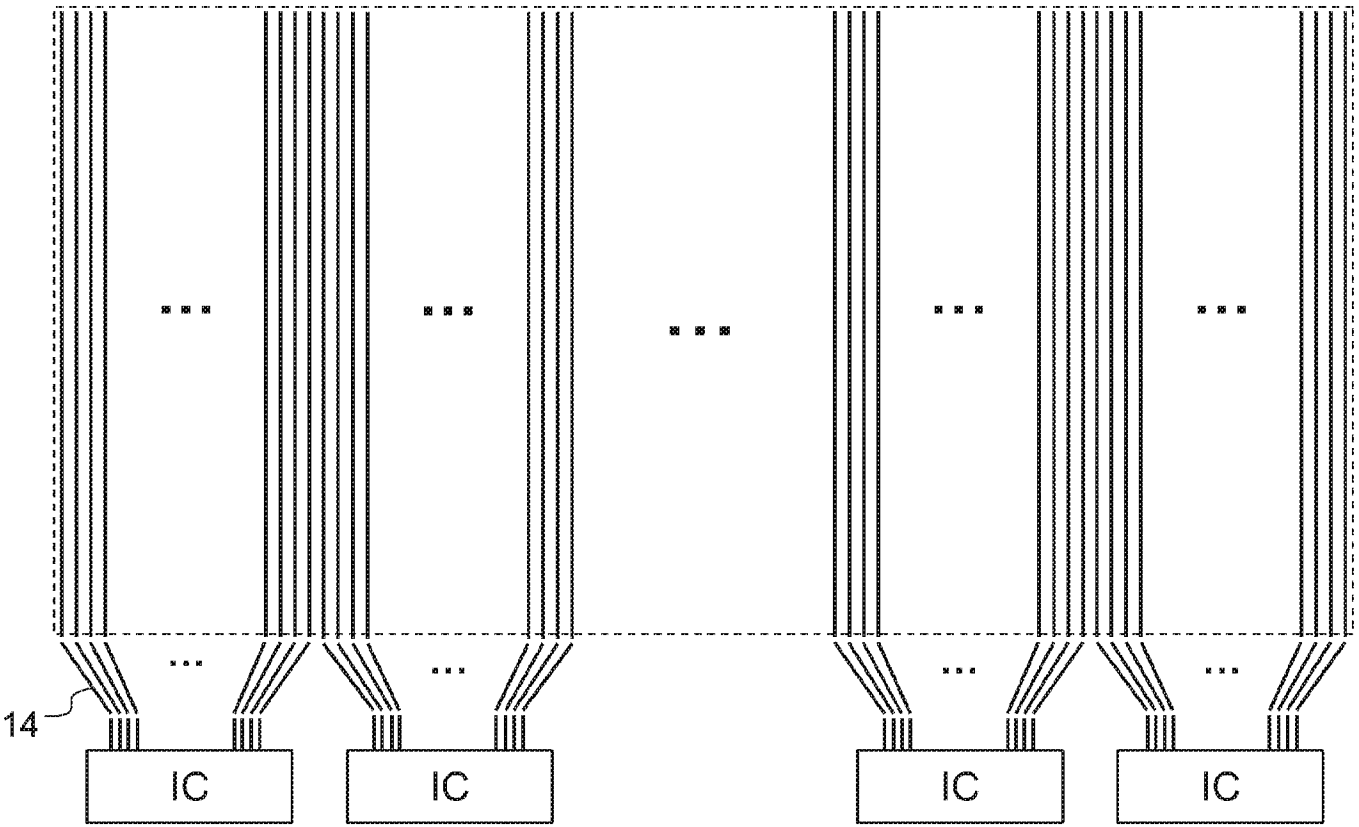
FIG. 13 is an example of column wiring patterns in a case where a column drive circuit comprises a plurality of ICs.

A crosstalk correction unit in a second embodiment of the present invention will be explained next based on FIG. 8. The second embodiment is a configuration example of a crosstalk correction unit for solving display defects such as those of FIG. 12B that may occur at IC boundaries in the column drive circuit 12. The explanation below will refer only to features different from those of the first embodiment.

Figure 8:
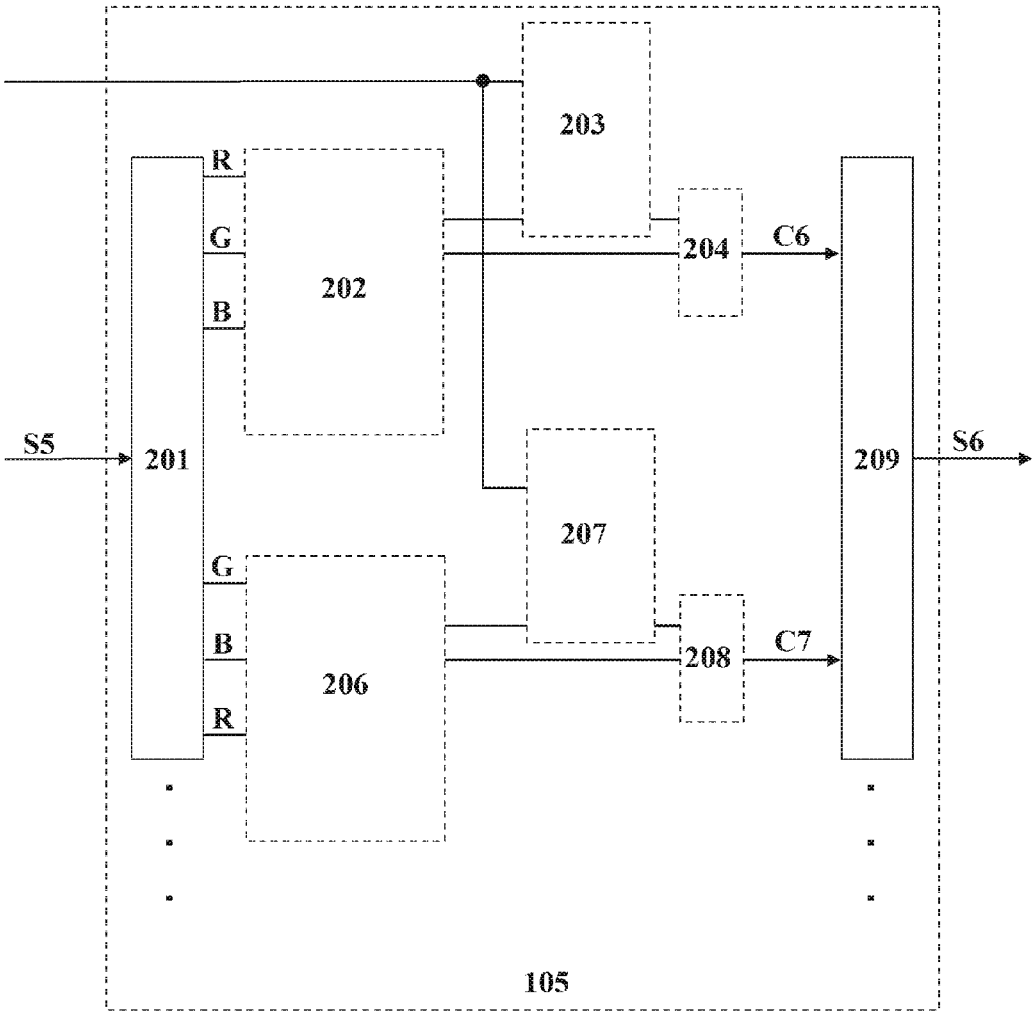
FIG. 8 is a diagram for explaining a configuration example of a crosstalk correction unit in a second embodiment.

As illustrated in FIG. 8, the crosstalk correction unit 105 in the second embodiment has the data sorting unit 201, the first gradation combination correction unit 202, the first column direction correction unit 203 and the first correction operation unit 204. The configurations of the foregoing are identical to those of the first embodiment (FIG. 1). The crosstalk correction unit 105 of the present embodiment comprises a second gradation combination correction unit 206, a second column direction correction unit 207, a second correction operation unit 208 and a correction data selection unit 209.

The corrected luminance data S5, having undergone fixed unevenness correction, is inputted to the data sorting unit 201. The data sorting unit 201 outputs, to the first gradation combination correction unit 202 or the second gradation combination correction unit 206, corrected luminance data of the pixel to be corrected (own pixel) and of adjacent pixels thereof. The data sorting unit 201 determines thereupon whether the column wiring of the own pixel is a column wiring at an IC boundary (column wiring connected to the endmost terminal of the IC). If the column wiring of the own pixel is a column wiring at an IC boundary, the corrected luminance data is outputted to the second gradation combination correction unit 206. Else, the corrected luminance data is outputted to the first gradation combination correction unit 202.

In both the first gradation combination correction unit 202 and the first column direction correction unit 203, values corresponding to column wirings other than at IC boundaries are stored in a look-up table for correction. In both the second gradation combination correction unit 206 and the second column direction correction unit 207, values corresponding to column wirings of IC boundaries are stored in look-up tables for correction. That is, an output C6 of the first correction operation unit 204 is corrected luminance data in which there is corrected the crosstalk amount obtained according to Equations (2) to (5) described above. An output C7 of the second correction operation unit 208 is corrected luminance data in which there is corrected the crosstalk amount obtained according to Equations (6) to (9). Equations (2) to (9) show that C6>C7. The outputs C6 and C7 are inputted to the correction data selection unit 209.

If the pixel to be corrected is a pixel connected to a column wiring other than at an IC boundary, the correction data selection unit 209 selects the output C6 and outputs the latter as crosstalk corrected luminance data S6. On the other hand, if the pixel to be corrected is a pixel connected to a column wiring at an IC boundary, the correction data selection unit 209 outputs the output C7 as the crosstalk corrected luminance data S6. This allows making the correction value for column wirings at an IC boundary smaller than the correction value for column wirings other than at an IC boundary. The correction data selection unit 209 may comprise, for instance, a selector circuit.

In the second embodiment, there are provided two types of correction value generation circuit (correction value generation unit), namely a circuit for column wirings at IC boundaries and a circuit for column wirings other than at IC boundaries. However, the present invention is not limited thereto, and there may be provided two or more types of correction value generation circuit for each position of the own pixel in the row direction. The configuration of the second embodiment is "selector+two gradation combination correction units+two column direction correction units+two correction operation units+selector", but the present invention is not limited thereto. The same effect can be elicited, for instance, by way of a configuration "gradation combination correction unit+selector+two column direction correction units+selector+correction operation unit", or a configuration "selector+two gradation combination correction units+selector+column direction correction unit+correction operation unit".

In the second embodiment described above, the correction values are set to be dissimilar according to the position of the own pixel in the row direction (connection position in the IC). In addition to the same effect elicited by the first embodiment, the second embodiment allows also correcting variability of the luminance fluctuation amount in the row direction caused by differences in capacitance between column wirings, and allows suppressing occurrence of vertical-streak display defects such as those illustrated in FIG. 12B.

Third Embodiment

A crosstalk correction unit in a third embodiment of the present invention will be explained based on FIG. 9, FIG. 10 and FIG. 11. The third embodiment is a configuration example of a crosstalk correction unit in a display device having a distribution (difference) of column wiring resistance and capacitance between adjacent column wirings, in the row direction, between the display region and the column drive circuit 12 (i.e. outside the display region).

In case of distribution of the column wiring resistance and the capacitance between column wirings, in the row direction, correction can be realized in accordance with the wiring resistance and capacitance between column wirings, for respective column wirings, by providing a plurality of types of correction circuits, as in the second embodiment. However, doing so is problematic in terms of the greater costs that are incurred on account of the larger memory and larger circuitry that accompany an increase in the number of correction circuits. The third embodiment, by contrast, allows realizing accurate correction using a simple circuit, through adjustment of correction values in the row direction using a look-up table according to a row-direction distribution of the column wiring resistance and the capacitance between column wirings.

Figure 9:
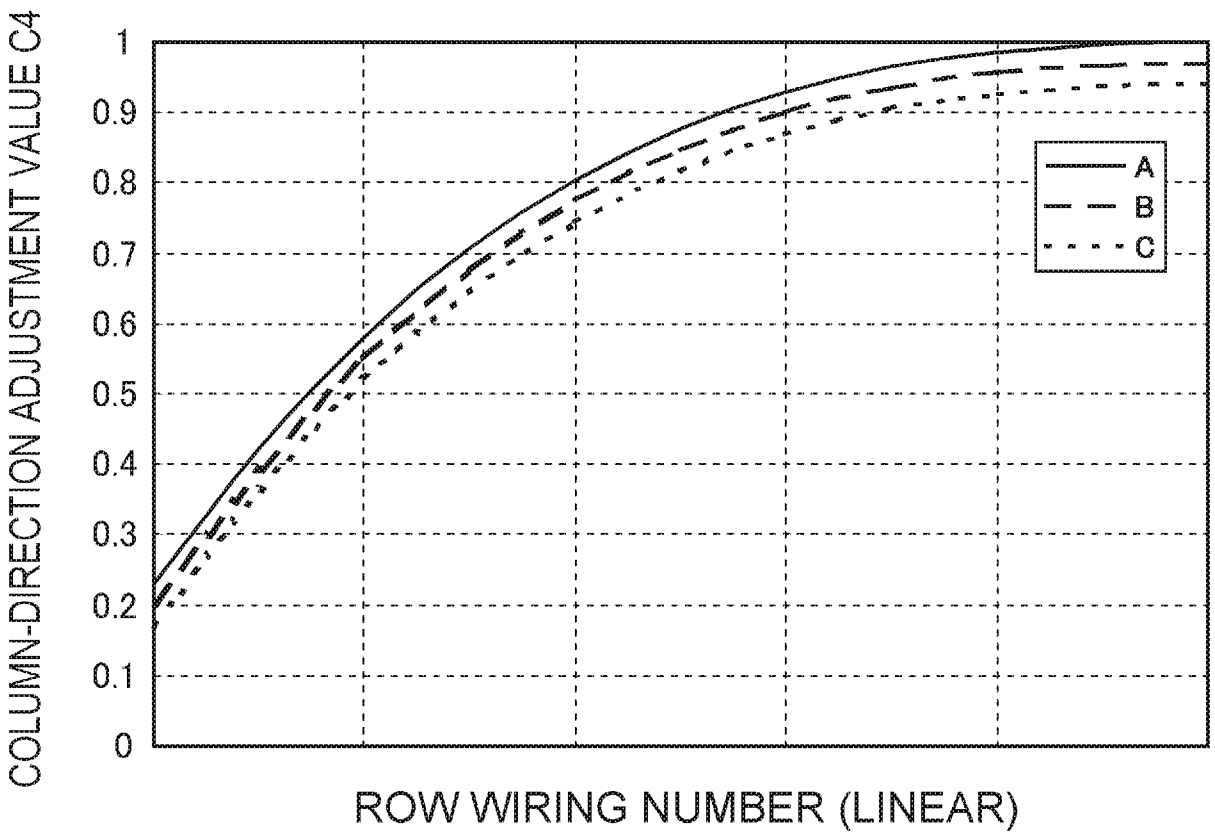
FIG. 9 is a difference of crosstalk amount in a case where wiring resistance and capacitance between column wirings exhibit a distribution in a row direction.

FIG. 9 is a diagram for explaining the crosstalk amount in a case where the column wiring resistance and the capacitance between column wirings exhibit a distribution in the row direction, between a display region and a column drive circuit. In the figure, the abscissa axis represents a row wiring number and the ordinate axis represents the column-direction adjustment value C4. The plot A in FIG. 9 corresponds to the column wiring (for instance, one wiring inward of an IC boundary) having the largest column wiring resistance and/or capacitance between column wirings outside the display region. The plot C corresponds to a column wiring (for instance, a column wiring at an IC boundary) having the smallest column wiring resistance and/or capacitance between column wirings outside the display region. The plot B corresponds to column wirings between A and B. As FIG. 9 shows, the crosstalk amount in the respective column wirings (A, B and C) shifts uniformly regardless of the row wiring number. This indicates that correction (adjustment) of the distribution in the row direction may involve addition or subtraction of an adjustment value, across the board, to/from a correction value, at a final stage. That is, adjustment of correction values in the row direction can be realized, by way of a simple configuration, by performing adjustment using a column-direction adjustment value, and performing adjustment thereafter using a row-direction adjustment value. The adjustment values vary depending on the combination of the modulation signals of the own pixel and the adjacent pixels, and hence the adjustment values may be determined with reference to the output of the gradation combination correction unit and with reference to the look-up table according to the distribution of column wiring resistance and capacitance between column wirings outside the display region.

Figure 11:
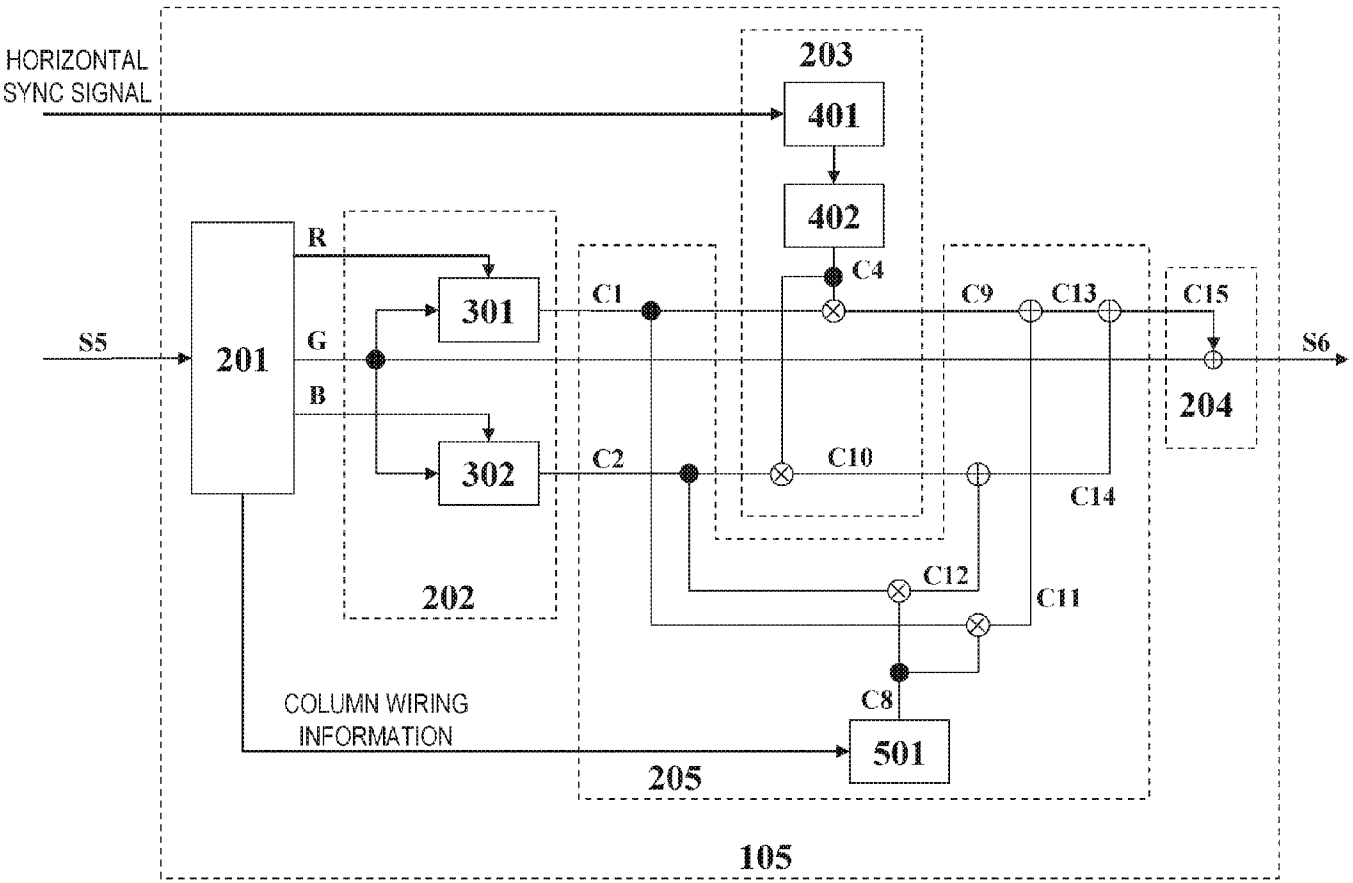
FIG. 11 is a diagram for explaining a configuration example of a crosstalk correction unit in a third embodiment.

FIG. 11 is a configuration example of a crosstalk correction unit in the third embodiment in which the principles of crosstalk occurrence, such as those described above, are factored in. The crosstalk correction unit 105 may comprise, for instance, the data sorting unit 201, the gradation combination correction unit 202, the column direction correction unit 203, the row direction correction unit 205 and the correction operation unit 204. In the present embodiment, the gradation combination correction unit 202, the column direction correction unit 203 and the row direction correction unit 205 correspond to the correction value generation unit of the present invention. The explanation below will refer only to features different from those of the first embodiment.

The data sorting unit 201 outputs, to the gradation combination correction unit 202, corrected luminance data S5 of the own pixel (G in FIG. 11) and corrected luminance data S5 of adjacent pixels (R and B in FIG. 11). The data sorting unit 201 outputs the column wiring information to the row direction correction unit 205. The column wiring information is, for instance, a wiring number (terminal number) in an IC that makes up the column drive circuit 12. The column wiring information may take on a value ranging from 1 to 80 if the IC has 80 outputs.

Unlike in the first embodiment, the gradation combination correction unit 202 does not combine the correction values C1 and C2, but outputs the foregoing without modification. The correction values C1 and C2 are inputted to the column direction correction unit 203 and the row direction correction unit 205. In the present embodiment, the GR correction value generation unit 301 and the GB correction value generation unit 302 output, as C1 and C2, correction values at a position where crosstalk is greatest i.e. at the open end for the column wiring at which crosstalk is greatest (for instance, column wiring inward of an IC boundary by one wiring). Specifically, the GR correction value generation unit 301 and the GB correction value generation unit 302 comprise each a look-up table in which there is stored a correction value corresponding to a crosstalk amount at an open end for a column wiring at which crosstalk is greatest. Hence, the correction amount in the correction values C1, C2 at this stage is not optimized for pixels other than at a position at which crosstalk is greatest. Therefore, the column direction correction unit 203 adjusts the correction value according to the distribution of crosstalk amount in the column direction, and the row direction correction unit 205 adjusts the correction values according to distribution of crosstalk amount in the row direction.

The column direction correction unit 203 multiplies the correction values C1 and C2 by the adjustment value C4 that utilizes a look-up table such as the one of plot A in FIG. 9, and outputs correction values C9 and C10 in which there is corrected the distribution of crosstalk amount in the column direction. Next, the row direction correction unit 205 generates adjustment values C11, C12 by multiplying the correction values C1 and C2 by an output C8 of the row direction correction value generation unit 501, and subtracts the respective adjustment values C11, C12 from the outputs C9, C10 of the column direction correction unit 203, to obtain thereby correction values C13, C14. The row direction correction unit 205 summates the correction values C13, C14, and outputs, to the correction operation unit 204, a resulting correction value C15 in which there is adjusted the distribution of crosstalk amount in the row direction. The correction operation unit 204 corrects the luminance data S5 of the own pixel using the correction value C15, and outputs the crosstalk corrected luminance data S6.

Figure 10:
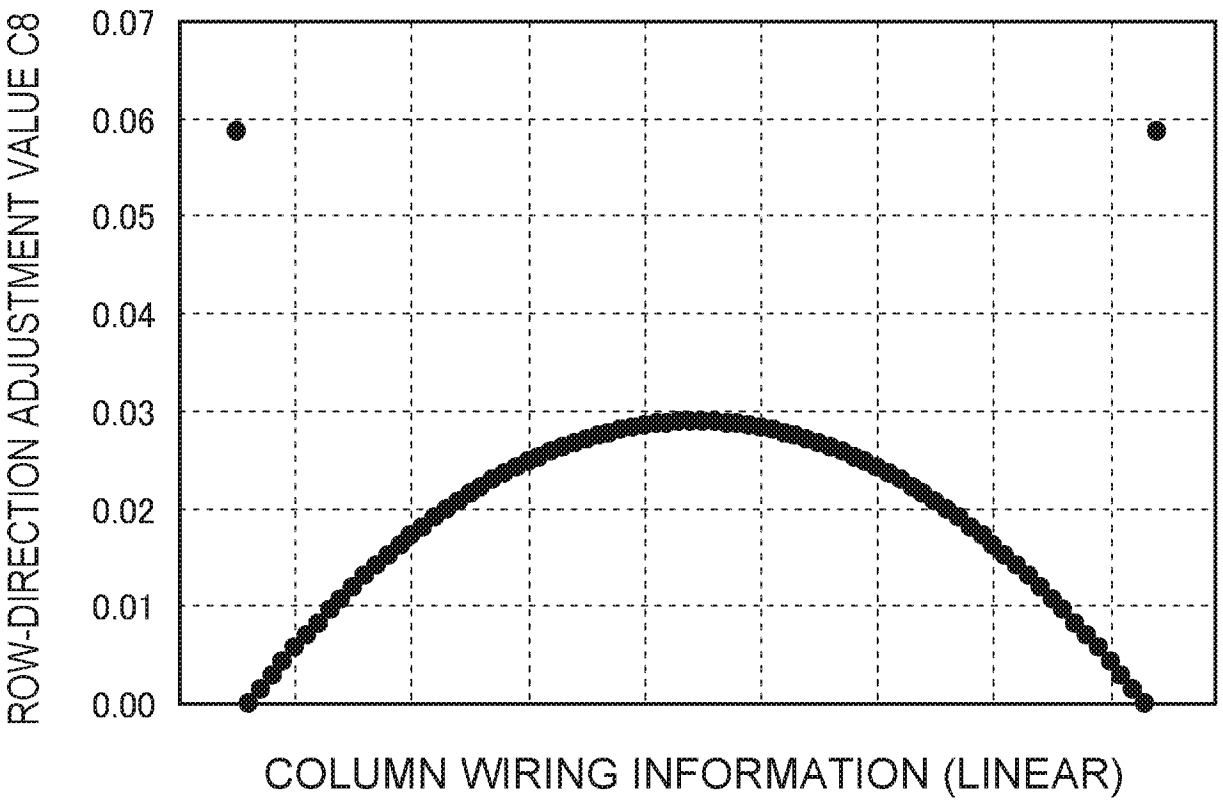
FIG. 10 is a diagram for explaining a configuration example of a row direction correction value generation unit.

The row direction correction value generation unit 501 may comprise a look-up table such as the one illustrated in FIG. 10. In FIG. 10, the abscissa axis is column wiring information (specifically, connection position of column wirings in an IC), and the ordinate axis is the row-direction adjustment value C8. The adjustment value C8 is greatest (about 0.06) at column wirings in IC boundaries. That is because, at an IC boundary, the correction values C9 and C10 must be reduced in proportion, compared to pixels that belong to column wirings at which crosstalk is greatest, as the capacitance between adjacent wirings becomes about half that in other lines, outside the display region. Accordingly, the absolute value of the final correction value C15 corresponding to column wirings at IC boundaries is smallest. The adjustment value C8 at a column wirings one wiring inward of the IC boundary is minimal (0). That is because, as FIG. 8 shows, column wirings adjacent to an IC boundary have a large wiring length and exhibit therefore the greatest wiring resistance and greatest capacitance between adjacent wirings. As a result, column wirings adjacent to an IC boundary exhibit the greatest crosstalk amount from among all the column wirings. The absolute value of the final correction value C15 is greatest at this time.

In the third embodiment, as described above, the adjustment values C11 and C12 are uniformly operated with the correction values C9 and C10 for which column direction adjustment has been performed. As a result, there can be corrected the variability of the luminance fluctuation amount in the row direction that arises on account of differences in wiring resistance and/or differences in capacitance between column wirings. In turn, this allows suppressing occurrence of vertical-streak display defects such as those illustrated in FIG. 12B. Further, the column direction adjustment and the row direction adjustment can each rely on a one-dimensional look-up table. A simple circuit can be configured as a result in which no cost increases are incurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-182460, filed on Aug. 17, 2010, which is hereby incorporated by reference herein in its entirety.

What is claimed is:

1. An image display apparatus having a plurality of pixels disposed at intersections between a plurality of row wirings and a plurality of column wirings, comprising:

a row drive unit that is connected to the plurality of row wirings and sequentially outputs a scan signal to an addressed row wiring;

a column drive unit that is connected to the plurality of column wirings and outputs modulation signals on the basis of luminance signals, to the plurality of column wirings in synchronism with the scan signal; and a control unit that generates the luminance signals on the basis of image signals and outputs the luminance signals to the column drive unit, wherein the control unit has a correction unit that performs a correction process on the image signals so as to suppress luminance fluctuation caused by capacitive coupling between adjacent column wirings, and the correction unit includes:

a correction value generation unit that determines a correction value for a pixel to be corrected on the basis of a combination of a signal value of the pixel to be corrected and signal values of adjacent pixels which are on a column wiring next to a column wiring on which the pixel to be corrected is, and on the basis of a position of the pixel to be corrected in a column direction; and a correction operation unit that corrects a signal of the pixel to be corrected using the correction value generated by the correction value generation unit.

2. The image display apparatus according to claim 1, wherein the correction value generation unit has a circuit that obtains a correction value corresponding to the combination of the signal value of the pixel to be corrected and the signal values of the adjacent pixels, and a circuit that adjusts the correction value using a column-direction adjustment value according to a position of the pixel to be corrected in the column direction.

3. The image display apparatus according to claim 2, wherein the column-direction adjustment value is used to correct a column-direction distribution of a luminance fluctuation amount caused by a voltage drop due to wiring resistance in the column wirings.

4. The image display apparatus according to claim 1, wherein the correction value generation unit determines a correction value on the basis of a combination of signal values of the pixel to be corrected and of the adjacent pixels, a position of the pixel to be corrected in the column direction, and also a position of the pixel to be corrected in a row direction.

5. The image display apparatus according to claim 4, wherein the column drive unit comprises a plurality of ICs to which a plurality of column wirings are respectively connected, and the correction value generation unit determines whether the column wiring of the pixel to be corrected is a wiring that is connected to an endmost terminal of the IC on the basis of the position of the pixel to be corrected in the row direction, and sets the correction value for the wiring connected to the endmost terminal of the IC to be smaller than the correction value for wirings other than this wiring.

6. The image display apparatus according to claim 4, wherein the column drive unit comprises a plurality of ICs to which a plurality of column wirings are respectively connected, and the correction value generation unit has a circuit that obtains a correction value corresponding to the combination of the signal value of the pixel to be corrected and the signal values of the adjacent pixels, a circuit that adjusts the correction value using a column-direction adjustment value according to a position of the pixel to be corrected in the column direction, and a circuit that adjusts the correction value using a row-direction adjustment value according to a connection position, in an IC, of the column wiring of the pixel to be corrected.

7. The image display apparatus according to claim 6, wherein the row-direction adjustment value is used to correct a row-direction distribution of a luminance fluctuation amount caused by a difference in wiring resistance between the column wirings, or a difference in capacitance between the adjacent column wirings, or both thereof.

8. The image display apparatus according to claim 6, wherein the correction value generation unit performs an adjustment that utilizes the row-direction adjustment value after an adjustment that utilizes the column-direction adjustment value.

9. The image display apparatus according to claim 7, wherein the correction value generation unit performs an adjustment that utilizes the row-direction adjustment value after an adjustment that utilizes the column-direction adjustment value.

10. A control method of an image display apparatus that is provided with: a plurality of pixels disposed at intersections between a plurality of row wirings and a plurality of column wirings; a row drive unit that is connected to the plurality of row wirings and sequentially outputs a scan signal to an addressed row wiring; and a column drive unit that is connected to the plurality of column wirings and outputs modulation signals to the plurality of column wirings in synchronism with the scan signal, the method comprising the steps of:

determining, in accordance with image signals, a correction value on the basis of a combination of a signal value of a pixel to be corrected and signal values of adjacent pixels which are on a column wirings next to a column wiring on which the pixel to be corrected is, and on the basis of a position of the pixel to be corrected in a column direction;

performing a correction process on the image signals so as to suppress luminance fluctuation caused by capacitive coupling between adjacent column wirings, by correcting a signal of the pixel to be corrected using the correction value; and outputting, to the column drive unit, the image signals performed the correction process.

* * * * *